US009421984B2

(12) United States Patent
Shubs, Jr. et al.

(10) Patent No.: US 9,421,984 B2
(45) Date of Patent: Aug. 23, 2016

(54) SAND MONITORING AND CONTROL SYSTEM FOR A MACHINE

(71) Applicant: ELECTRO-MOTIVE DIESEL, INC., LaGrange, IL (US)

(72) Inventors: Alexander Shubs, Jr., Chicago, IL (US); Francis Vogels, Calgary (CA)

(73) Assignee: Electro-Motive Diesel, Inc., La Grange, IL (US)

( * ) Notice: Subject to any disclaimer, the term of this patent is extended or adjusted under 35 U.S.C. 154(b) by 238 days.

(21) Appl. No.: 14/013,054

(22) Filed: Aug. 29, 2013

(65) Prior Publication Data

US 2015/0061299 A1 Mar. 5, 2015

(51) Int. Cl.
*B61C 15/10* (2006.01)

(52) U.S. Cl.
CPC ..... *B61C 15/107* (2013.01)

(58) Field of Classification Search
CPC ... B61C 15/10; B61C 15/102; B61C 15/105; B61C 15/107
USPC ..... 73/149, 861
See application file for complete search history.

(56) References Cited

U.S. PATENT DOCUMENTS

| | | | | |
|---|---|---|---|---|
| 4,799,161 | A * | 1/1989 | Hirotsu et al. | 701/70 |
| 5,477,941 | A * | 12/1995 | Kumar et al. | 184/3.2 |
| 6,067,927 | A | 5/2000 | Johnson et al. | |
| 6,629,709 | B1 * | 10/2003 | Tunley et al. | 291/2 |
| 6,722,589 | B1 * | 4/2004 | Ohno et al. | 239/654 |
| 8,397,560 | B2 | 3/2013 | De Sanzo et al. | |
| 2004/0160064 | A1 * | 8/2004 | Kish et al. | 291/3 |
| 2005/0140144 | A1 * | 6/2005 | Kumar | 291/2 |
| 2005/0253397 | A1 * | 11/2005 | Kumar et al. | 291/2 |
| 2008/0252082 | A1 * | 10/2008 | Bartling | 291/3 |
| 2012/0061367 | A1 * | 3/2012 | Wolff et al. | 219/202 |
| 2012/0158223 | A1 * | 6/2012 | Liberatore et al. | 701/19 |
| 2013/0036815 | A1 * | 2/2013 | Bernhardsgruetter | A47J 31/4457 73/290 V |
| 2013/0173094 | A1 * | 7/2013 | Cooper et al. | 701/19 |
| 2013/0206862 | A1 * | 8/2013 | Worden et al. | 239/99 |
| 2014/0151460 | A1 * | 6/2014 | Noffsinger et al. | 239/69 |

FOREIGN PATENT DOCUMENTS

| | | |
|---|---|---|
| BR | PI0901610 | 12/2010 |
| FR | 2667936 | 4/1992 |
| JP | 61002007 | 1/1986 |
| WO | WO 2011/154401 | 12/2011 |

* cited by examiner

*Primary Examiner* — Zachary Kuhfuss
(74) *Attorney, Agent, or Firm* — Finnegan, Henderson, Farabow, Garrett & Dunner, LLP

(57) ABSTRACT

A sand monitoring and control system for a machine is disclosed. The sand monitoring and control system may have a sand box configured to hold sand. The sand monitoring and control system may further have a duct connected to the sand box. The duct may be configured to dispense sand from the sand box to a wheel of the machine. The sand monitoring and control system may also have a valve connected to the duct. In addition, the sand monitoring and control system may have a controller in communication with the valve. The controller may be configured to adjust the valve to control a flow-rate of sand through the duct.

16 Claims, 4 Drawing Sheets

SAND MONITORING AND CONTROL SYSTEM FOR A MACHINE

TECHNICAL FIELD

The present disclosure relates generally to a sand monitoring and control system and, more particularly, to a sand monitoring and control system for a machine.

BACKGROUND

Railroad locomotives may experience wheel slip during rainy or icy weather conditions. For example, wheels of a locomotive may slip on a wet or icy railroad track when the locomotive attempts to start pulling stationary railroad cars. The wheels may also slip, for example, when a locomotive operator applies the brakes to stop a fast moving locomotive on a slippery railroad track. Locomotives typically include a sand dispensing system, which dispenses sand near the wheels of the locomotive. The sand comes between the wheels of the locomotive and the railroad track, increasing friction between the contacting surfaces and providing improved traction.

A locomotive operator may detect wheel slip based on signals from a wheel slip sensor. The operator may then push a button or engage a lever to dispense sand from sand boxes located on the locomotive. The operator may, however, be unaware of the amount of sand remaining in the sand boxes or of the flow-rate at which sand is being dispensed. Moreover, when the sand boxes are empty, do not have a sufficient amount of sand, or when the flow-rate of sand is too low, the operator may find it difficult to control the wheel slip. Because of safety restrictions on many railroads, a manual inspection of the sand boxes or the valves, which control the sand flow-rate, before or during operation of the locomotive, is difficult and inaccurate.

One attempt to address some of the problems described above is disclosed in U.S. Pat. No. 8,397,560 of De Sanzo et al. that issued on Mar. 19, 2013 ("the '560 patent"). In particular, the '560 patent discloses a system for monitoring a sand reservoir including at least one sand level indicator. The sand level indicator of the '560 patent provides a visual display external to the sand reservoir to indicate the quantity of sand within the reservoir. The '560 patent further discloses that the sand level indicator can transmit a signal, which indicates the presence or absence of sand in the sand reservoir, to a remote station. In addition, the '560 patent discloses that the sand level and related data may be used, among other things, to avoid an "out of sand" condition, to detect excess sand usage, or to trigger an alert if the sand level has not decreased over a predefined amount of time.

Although the '560 patent discloses a system for monitoring a sand reservoir, the disclosed system may still be inadequate. For example, the system of the '560 patent does not detect the flow-rate of sand from the sand boxes. Thus, the system of the '560 patent may not allow the operator to adjust the flow-rate at which sand is dispensed to adequately respond to a detected wheel slip condition. Moreover, although the system of the '560 patent may detect an "out of sand" condition, it does not provide the operator with any alternative method of providing sand to the wheels of the locomotive.

The sand monitoring and control system of the present disclosure solves one or more of the problems set forth above and/or other problems in the art.

SUMMARY

In one aspect, the present disclosure is directed to a sand monitoring and control system for a machine. The sand monitoring and control system may include a sand box configured to hold sand. The sand monitoring and control system may further include a duct connected to the sand box. The duct may be configured to dispense sand from the sand box to a wheel of the machine. The sand monitoring and control system may also include a valve connected to the duct. In addition, the sand monitoring and control system may include a controller in communication with the valve. The controller may be configured to adjust the valve to control a flow-rate of sand through the duct.

In another aspect, the present disclosure is directed to a method of traction control for a machine. The method may include detecting wheel slip using a slip sensor. The method may also include opening a valve to allow sand to flow from a sand box through a duct when wheel slip has been detected. The method may further include dispensing the sand to a wheel of the machine. The method may include determining a flow-rate of the sand flowing through the duct. In addition, the method may include adjusting the valve to control the flow-rate.

DETAILED DESCRIPTION

Figure 1:
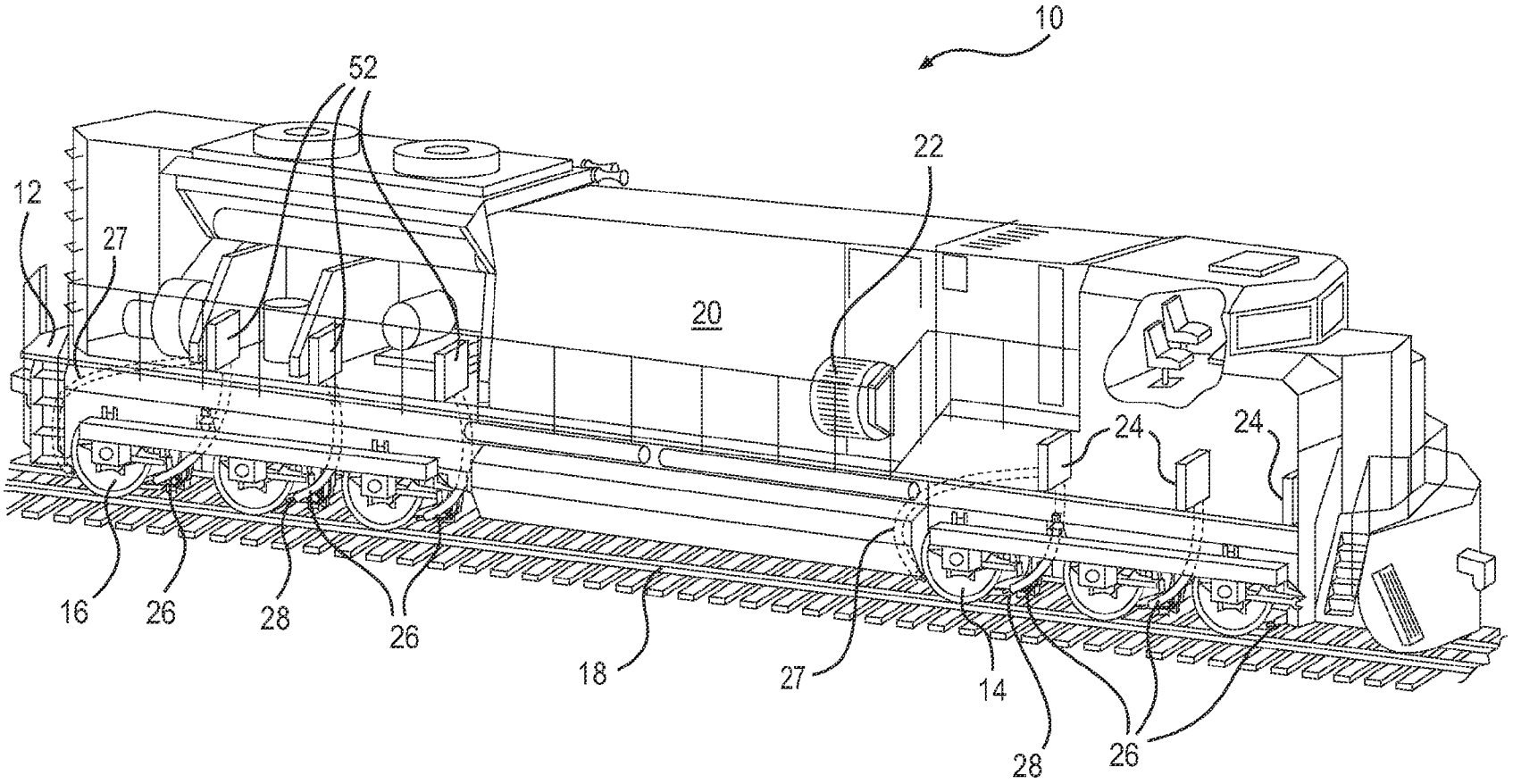
FIG. 1 is a pictorial illustration of an exemplary disclosed machine.

FIG. 1 illustrates an exemplary embodiment of a machine 10. For example, as shown in FIG. 1, machine 10 may be a locomotive designed to pull rolling stock. Machine 10 may have a platform 12. A plurality of wheels 14, 16 may be configured to support platform 12. Wheels 14, 16 may also be configured to engage track 18. Although FIG. 1 illustrates wheels 14 as located nearer a front end of machine 10 and wheels 16 located nearer a rear end of machine 10, it is contemplated that wheels 14, 16 may be located in any wheel position on machine 10. Wheels 14, 16 may have traction motors (not shown) associated with them, which may drive wheels 14, 16 to propel machine 10 in a forward or rearward direction.

Machine 10 may have an engine 20 mounted on platform 12. Engine 20 may be configured to drive one or more generators 22, which may generate power to drive the traction motors. The one or more generators 22 may also be mounted on platform 12 of machine 10. Although FIG. 1 depicts one engine 20, it is contemplated that machine 10 may have more than one engine 20, which may drive the one or more generators 22. In an exemplary embodiment, as shown in FIG. 1, engine 20 may be lengthwise aligned on platform 12 along a travel direction of machine 10. One skilled in the art will recognize, however, that engine 20 may be located in tandem, transversally, or in any other orientation on platform 12.

Machine 10 may include one or more sand boxes 24, 52. Ducts 26 may be connected at one end to sand boxes 24, 52. Distal ends of ducts 26 may be disposed near wheels 14, 16. Each duct 26 may allow sand from a sand box 24 or 52 to be dispensed near a wheel 14 or 16, respectively. Each duct 26 may also be equipped with a nozzle 28 to direct sand from sand box 24 or 52 to wheel 14 or 16, respectively, so that sand may be crushed between wheels 14, 16 and track 18 to provide improved traction to wheels 14, 16. In one exemplary embodiment, as shown in FIG. 1, duct 27 may allow sand from a sand box 24 or 54 to be dispensed near a wheel on a side opposite to a side on which duct 26 dispenses sand. Such a configuration may allow sanding operations to be performed regardless of a travel direction of machine 10. Although FIG. 1 shows only one wheel 14 and one wheel 16 having both ducts 26 and 27, one skilled in the art would recognize that ducts 26 and 27 may dispense sand from first or second sand boxes 24, 52 on both sides of only some wheels 14, 16 or all wheels 14, 16 of machine 10.

In another exemplary embodiment, as shown in FIG. 1, each wheel 14 or 16 may have its own dedicated sand box 24 or 52, respectively. It is contemplated, however, that more than one sand boxes 24, 52 and/or ducts 26, 27 may supply sand to wheels 14, 16. It is also contemplated that one sand box 24 or 52 may supply sand to more than one wheel 14 or 16 using one or more ducts 26, 27. Sand boxes 24, 52 may be fixedly attached to machine 10 or may be removable. In an exemplary embodiment, as shown in FIG. 1, sand boxes 24, 52 may be located on platform 12 near wheels 14, 16, respectively. One skilled in the art will recognize, however, that sand boxes 24, 52 may be located anywhere on machine 10.

Figure 2:
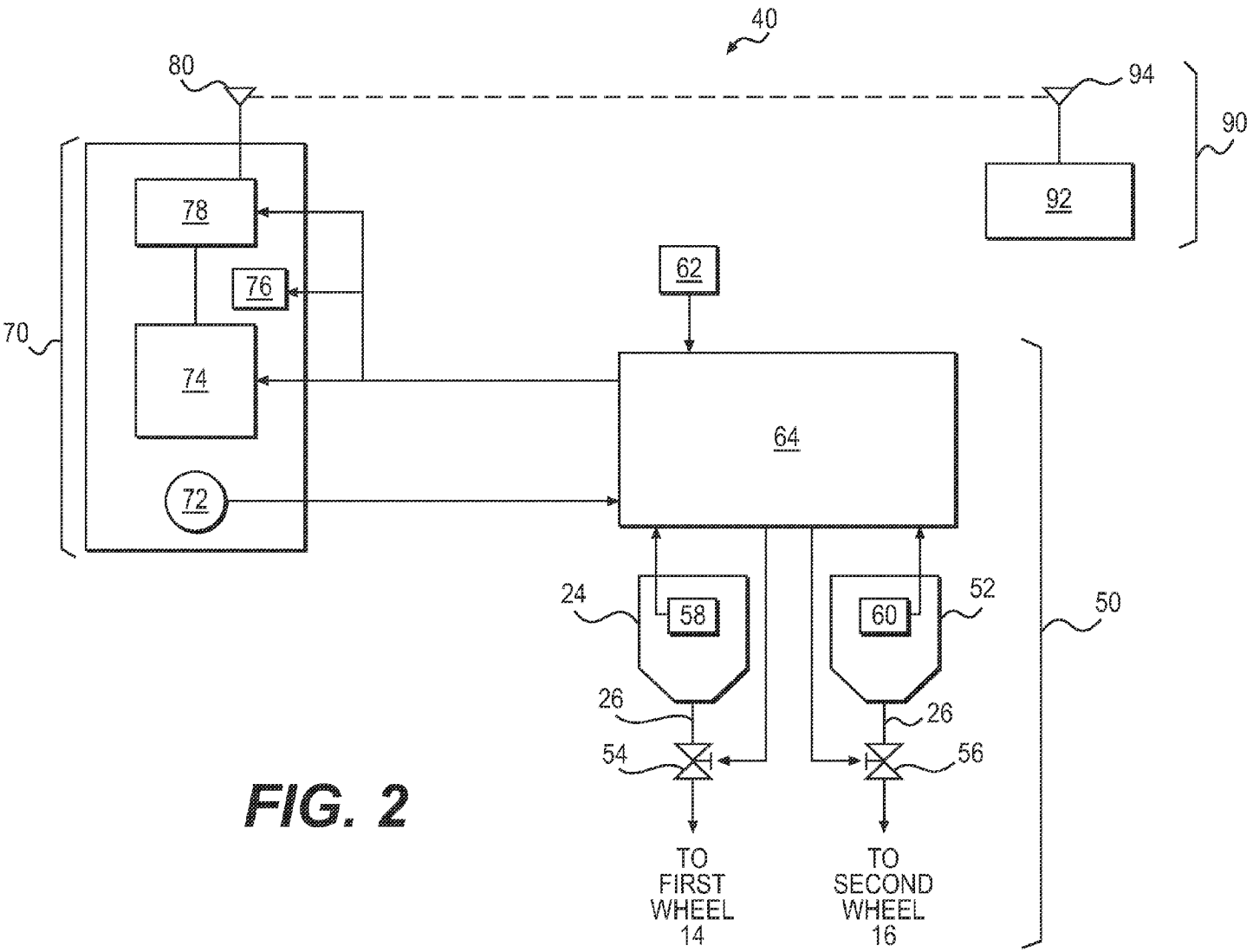
FIG. 2 is a schematic of an exemplary disclosed sand monitoring and control system for the machine of FIG. 1.

FIG. 2 illustrates an exemplary disclosed sand monitoring and control system 40 for machine 10. As shown in the figure, sand monitoring and control system 40 may include sand dispensing system 50, instrumentation system 70, and remote monitoring system 90. Sand dispensing system 50 may include first sand box 24, second sand box 52, first valve 54, second valve 56, first sensor 58, second sensor 60, slip sensor 62, and controller 64. First and second sand boxes 24, 52, may be configured to hold sand for use in fraction control operations for machine 10. Although FIG. 2 illustrates only two sand boxes, namely first and second sand box 24 and 52, it is contemplated that sand monitoring and control system 40 may include any number of first and second sand boxes 24 and/or 52. It is also contemplated that first and second sand boxes 24, 52 may be located on the same machine 10 or on different machines 10. One end of ducts 26 and/or 27 may be connected to each of first and second sand boxes 24, 52. Distal ends of ducts 26, 27 may be disposed near wheels 14, 16. It is contemplated that more than one duct 26 and/or 27 may be connected to each of first and second sand boxes 24, 52 to allow sand to be dispensed from each of first and second sand boxes 24, 52 to more than one wheel 14, 16. It is also contemplated that ducts 26, 27 may be connected to first and second sand boxes 24, 52 to permit sand to be dispensed from more than one first and/or second sand box 24, 52 to a single wheel 14 or 16.

First valve 54 may be connected to duct 26 of first sand box 24. First valve 54 may be selectively adjustable to control a first flow-rate of sand from first sand box 24 to first wheel 14. Second control valve 56 may be connected to duct 26 of second sand box 52. Second control valve 56 may be selectively adjustable to control a second flow-rate of sand from second sand box 52 to second wheel 16.

First valve 54 may be a two position or proportional type valve having a valve element movable to allow sand to flow from first sand box 24 through duct 26 to first wheel 14. The valve element in first valve 54 may be hydraulic or pneumatic and may be operable to move between a flow-passing position and a flow-blocking position. It is contemplated that the valve element in first valve 54 may be solenoid-operable, mechanically-operable, electrically-operable, or operable in any other manner known in the art. In the flow-passing position, first valve 54 may permit sand to flow from first sand box 24 through duct 26 to first wheel 14, causing improved traction between first wheel 14 and track 18. In contrast, in the flow-blocking position, first valve 54 may completely block sand from flowing through duct 26. Second valve 56 may have a structure and function similar to that of first valve 54. It is contemplated that in one exemplary embodiment first and/or second valves 54, 56 may be fixed-flow valves in which the valve element may have only two positions such that firs and/or second valves 54, 56 may either be fully open or fully closed.

First sensor 58 may be attached to or mounted near first sand box 24. First sensor 58 may be configured to determine a level of sand in first sand box 24. As used in this disclosure, level of sand refers to a height of sand as measured from a bottom surface or a reference location near the bottom surface of first or second sand box 24, 52. As used in this disclosure, level of sand may also refer to a depth of the surface of the sand as measured from a reference location above the surface of the sand. It is also contemplated that first sensor 58 may be configured to determine an amount of sand in first sand box 24. As used in this disclosure, amount of sand refers to the volume, mass, or weight of the sand in first or second sand box 24, 52.

First sensor 58 may be configured to determine a level or amount of sand in first sand box 24 at different times. It is also contemplated that first sensor 58 may be configured to determine the level or amount of sand in first sand box 24 at a time specified by controller 64 or by an operator of machine 10. First sensor 58 may be an acoustic sensor, an ultrasonic sensor, an infra-red sensor, an optical sensor, a load cell, a pressure sensor, or any other type of sensor known in the art for the measurement of height, depth, volume, mass, or weight.

First sensor 58 may be configured to communicate information regarding the level or amount of sand in first sand box 24 to controller 64. First sensor 58 may communicate information to controller 64 wirelessly or through wires or cables connecting first sensor 58 to controller 64. Second sensor 60 may be configured to determine a level of sand or an amount of sand in second sand box 52. Second sensor 60 may have a structure and function similar to that of first sensor 58. Although, FIG. 2 illustrates an embodiment in which only one sensor is associated with each of first and second sand boxes 24, 52, one skilled in the art would recognize that more than one first and second sensors 58, 60 may be attached to or mounted near first and second sand boxes 24, 52, respectively, to determine the level or amount of sand in first and second sand boxes 24, 52.

Slip sensor 62 may be configured to determine whether first wheel 14 or second wheel 16 may be slipping on track 18. Slip sensor may determine a wheel slip condition based on a speed of machine 10, a position or distance of travel of machine 10, a rotational speed of first or second wheel 14 or 16, and a dimension of first or second wheel 14 or 16. As used in this disclosure, rotational speed may be measured in terms of revolutions per unit time or in terms of an angular speed. In one exemplary embodiment, slip sensor 62 may detect a wheel slip condition by comparing the distance travelled by machine 10 in a given time period with the linear distance travelled by a center of first or second wheel 14 or 16 in the same time period. The distance travelled by machine 10 may be determined based on the speed of machine 10 and the distance travelled by the center of first or second wheel 14 or 16 may be determined based on the angular speed of first or second wheel 14 or 16, respectively. Slip sensor 62 may communicate information regarding wheel slip to controller 64 wirelessly or through wires or cables connecting slip sensor 62 to controller 64. It is also contemplated that slip sensor 62 may communicate information regarding an amount or magnitude of wheel slip to controller 64.

Although the above disclosure describes detecting wheel slip using slip sensor 62, one skilled in the art would recognize that wheel slip may be detected in many other ways. For example, signals from an on-board or off-board radar system, or an on-board GPS system may be used by controller 64 to detect wheel slip. It is also contemplated that measurements of current flow to the traction motors associated with wheels 14, 16, signals from encoders associated with wheels 14, 16, and/or signals from generators 22 may be used by controller 64 to detect wheel slip.

Controller 64 may be in communication with first and second valves 54, 56, first and second sensors 58, 60, slip sensor 62, and instrumentation system 70. Controller 64 may be configured to monitor a first flow-rate of sand flowing from first sand box 24 and a second flow-rate of sand flowing from second sand box 52. Controller 64 may determine the first flow-rate based on signals and/or information communicated by first sensor 58 to controller 64. It is contemplated that controller 64 may receive information regarding an amount of sand in first sand box 24 from first sensor 58. It is also contemplated that controller 64 may receive information regarding a level of sand in first sand box 24 from first sensor 58 and may determine an amount of sand in first sand box 24 based on the level information. It is further contemplated that controller 64 may determine the first flow-rate based on characteristics of first valve 54 and an amount of opening of first valve 54. For example, controller 64 may determine the first flow-rate as half of a maximum flow-rate allowed by first valve 54 when the amount of opening of first valve 54 is half of a maximum amount of opening. It is also contemplated that controller 64 may determine the first flow-rate based on the detected amount or magnitude of wheel slip detected by slip sensor 62. Controller 64 may determine the second flow-rate based on signals, information regarding a level or amount of sand in second sand box 52 received from second sensor 60, opening of second valve 56, and/or the amount or magnitude of wheel slip detected by slip sensor 62 in a similar manner.

Controller 64 may be configured to selectively adjust first valve 54 to increase or decrease the first flow-rate of sand. For example, controller 64 may be configured to increase the first flow-rate by moving a valve element in first valve 54 to increase a flow area of sand through first valve 54. Similarly, controller 64 may decrease the first flow-rate by decreasing the flow area in first valve 54. Controller 64 may be configured to monitor and control the second flow-rate by adjusting second valve 56 in a manner similar to the adjustments of first valve 54.

It is contemplated that in an exemplary embodiment in which first and/or second valves 54, 56 is a fixed-flow valve, controller 64 may control an amount of sand delivered to wheels 14, 16 by allowing first and/or second valves 54, 56 to remain open for a longer or shorter time period, respectively. One skilled in the art would recognize that the first and/or second flow-rate from first and/or second valves 54, 56 may be lower than the target flow-rate because first and/or second valves 54, 56 may be malfunctioning or because there may be some blockage in duct 26. For example, when controller 64 detects that first flow-rate is less than the target flow-rate, controller 64 may keep first valve 54 open for a longer period of time.

Controller 64 may embody a single microprocessor or multiple microprocessors, field programmable gate arrays (FPGAs), digital signal processors (DSPs), etc. Controller 64 may be configured to control operations of sand monitoring and control system 40. It is contemplated that controller 64 may be configured to control operations of machine 10. Additionally or alternatively, controller 64 may be configured to communicate with another controller (not shown), which may be configured to control operations of machine 10. Various other known circuits may be associated with controller 64, including power supply circuitry, signal-conditioning circuitry, actuator driver circuitry (i.e., circuitry powering solenoids, motors, or piezo actuators), communication circuitry, and other appropriate circuitry.

Instrumentation system 70 may include button 72, display 74, alarm 76, communications module 78 and antenna 80. Button 72 may be configured to permit an operator of machine 10 to control dispensing of sand from first and/or second sand boxes 24, 52. Button 72 may be configured to communicate a signal to controller 64, which may selectively open or close first and second valves 54, 56, to dispense sand from first and second sand boxes 24, 52, respectively. It is contemplated, however, that button 72 may be configured to directly communicate with first and second valves 54, 56 to selectively open or close first and second valves 54, 56 to dispense sand from first and second sand boxes 24, 52, respectively. Although FIG. 2 illustrates only one button 72, it is contemplated that instrumentation system 70 may be equipped with more than one button 72 to initiate and control the flow of sand from the one or more first and second sand boxes 24, 52. It is also contemplated that separate buttons 72 may be used to initiate and control the flow of sand from first sand box 24 and second sand box 52. It is further contemplated that buttons 72 may be activated by touching, pressing, rotating, and/or moving buttons 72. It is also contemplated that buttons 72 may take the form of levers, wheels, touch control widgets, or any other structure known in the art for adjusting first and second valves 54, 56.

Instrumentation system 70 may include display 74, which may be configured to display information received from controller 64. Display 74 may be monochromatic or may be capable of displaying a multitude of colors. Display 74 may be a liquid crystal display, a cathode ray tube display, a touch screen display, a plasma display, a light-emitting-diode display, or any other type of display known in the art for displaying information to an operator of machine 10. Display 74 may also be configured to display widgets and/or other graphics, which may be activated using touch controls by an operator of machine 10 to control or monitor sand monitoring and control system 40.

Instrumentation system 70 may include an alarm 76. Alternatively or additionally, alarm 76 may be located within a control cabin of machine 10, within remote monitoring system 90, or at a central location for monitoring the status of one or more machines 10 and one or more sand monitoring and control systems 40, for example, in a central control room or maintenance department. Alarm 76 may be audible, visual, or both. In one exemplary embodiment, alarm 76 may be included in display 74. Alarm 76 may be triggered by controller 64, when controller 64 determines that the first or second flow-rate differs from a target flow-rate or when first or second sand boxes 24, 52 run out of sand.

Instrumentation system 70 may include a communications module 78, which may be configured to communicate information and data received from display 74 or from controller 64 to remote monitoring system 90. Communications module 78 may communicate wirelessly with remote monitoring system 90. Communications module 78 may be equipped with an antenna 80 to transmit or receive signals to and from server 92. Although FIG. 2 depicts communications module 78 as transmitting and receiving signals wirelessly via antenna 80, it is contemplated that communications module 78 may receive signals via other methods known in the art. For example, communications module 78 may receive signals from other communications devices (not shown) or from remote monitoring system 90 via a wired connection, a network connection, a cellular connection, a satellite connection, or by any other means of communication known in the art.

Remote monitoring system 90 may include server 92 and antenna 94. Server 92 may include one or more servers configured to interact with one or more communications modules 78 or controllers 64. Server 92 may be a desktop computer or a server computer. Server 92 may be implemented as a server, a server system comprising a plurality of servers, or a server farm comprising a load balancing system and a plurality of servers. Alternatively, server 92 may be a portable computer, for example, a laptop computer, a tablet computer, or another mobile device known in the art. Server 92 may include a number of components, such as one or more processor(s), memory device(s) and other storage devices for storing instructions executed by the processor(s) and/or for storing for electronic communications and other data. Examples of memory devices and other storage devices include hard drives, NOR, NAND, ROM devices, etc. Server 92 may also include a display device for displaying data and information. Server 92 may be equipped with input devices, which may include physical keyboards, virtual touch-screen keyboards, mice, joysticks, styluses, etc. In one exemplary embodiment, server 92 may also be capable of receiving input through a microphone using voice recognition applications. Server 92 may be equipped with antenna 94 to wirelessly communicate with communications module 78 or controller 64. It is contemplated however that server 92 may transmit or receive signals from communications modules 78 or controllers 64 via a wired connection, a network connection, a cellular connection, a satellite connection, or by any other means of communication known in the art.

Server 92 may be configured to receive information and data from communications module 78. Server 92 may use the information and data to determine a first flow-rate and a second flow-rate of sand flowing from first and second sand box 24, 52, respectively. Additionally or alternatively, server 92 may also determine an amount of sand remaining in first and second sand boxes 24, 52. Server 92 may compare the first or second flow-rate to a target flow-rate and communicate results of the comparison to communications module 78. It is also contemplated that server 92 may direct controller 64 to adjust first and/or second valves 54, 56 to control first and/or second flow-rates of sand from first and second sand boxes 24, 52, respectively. In one exemplary embodiment, server 92 may be configured to trigger alarm 76 when first or second sand box 24, 52 runs out of sand, or when the first or second flow-rate differs from the target flow-rate. Server 92 may use information regarding sand usage and amounts obtained from one or more communications modules 78 or controllers 64 in one or more machines 10 to perform safety or supply audits and monitor the availability of sand throughout the railroad system. One skilled in the art would recognize that all the functions of server 92 described above may be performed by controller 64 or vice-versa.

Controller 64 and/or server 92 may also be configured to log failures in a maintenance archive, which may be stored on machine 10 or at a remote location. For example, when controller 64 or server 92 detects that the first or second flow-rate differs from the target flow-rate, controller 64 or server 92 may log the detected condition in a maintenance archive. Controller 64 and server 92 may also log trends in the first and/or second flow-rates of sand in the maintenance archive. The maintenance archive may be used to schedule maintenance for sand monitoring and control system 40. Additionally or alternatively, controller 64 and/or server 92 may use the information in the maintenance archive to control first and/or second valves 54, 56 to adjust the first and/or second flow-rates of sand.

An exemplary traction control operation of sand monitoring and control system 40 will be described next.

INDUSTRIAL APPLICABILITY

The disclosed sand monitoring and control system may be used in any machine or power system application where it is beneficial to improve traction control by using sand to increase the friction between wheels of the machine and a surface (e.g. track) in contact with the wheel. The disclosed sand monitoring and control system may find particular applicability with mobile machines such as locomotives during rainy or wintry weather conditions. The disclosed sand monitoring and control system may provide an improved method for controlling the traction of the machine in such adverse weather conditions by monitoring and controlling a flow-rate of sand from a sand box. For example, the disclosed sand monitoring and control system may provide an improved method for dispensing sand based on a controlled flow-rate of sand exiting a sand box. The disclosed sand monitoring and control system may also provide an improved method for dispensing sand from a second sand box when a first flow-rate of sand from a first sand box is too low or when the first-sand box has run out of sand. Operation of sand monitoring and control system 40 will now be described.

Figure 3:
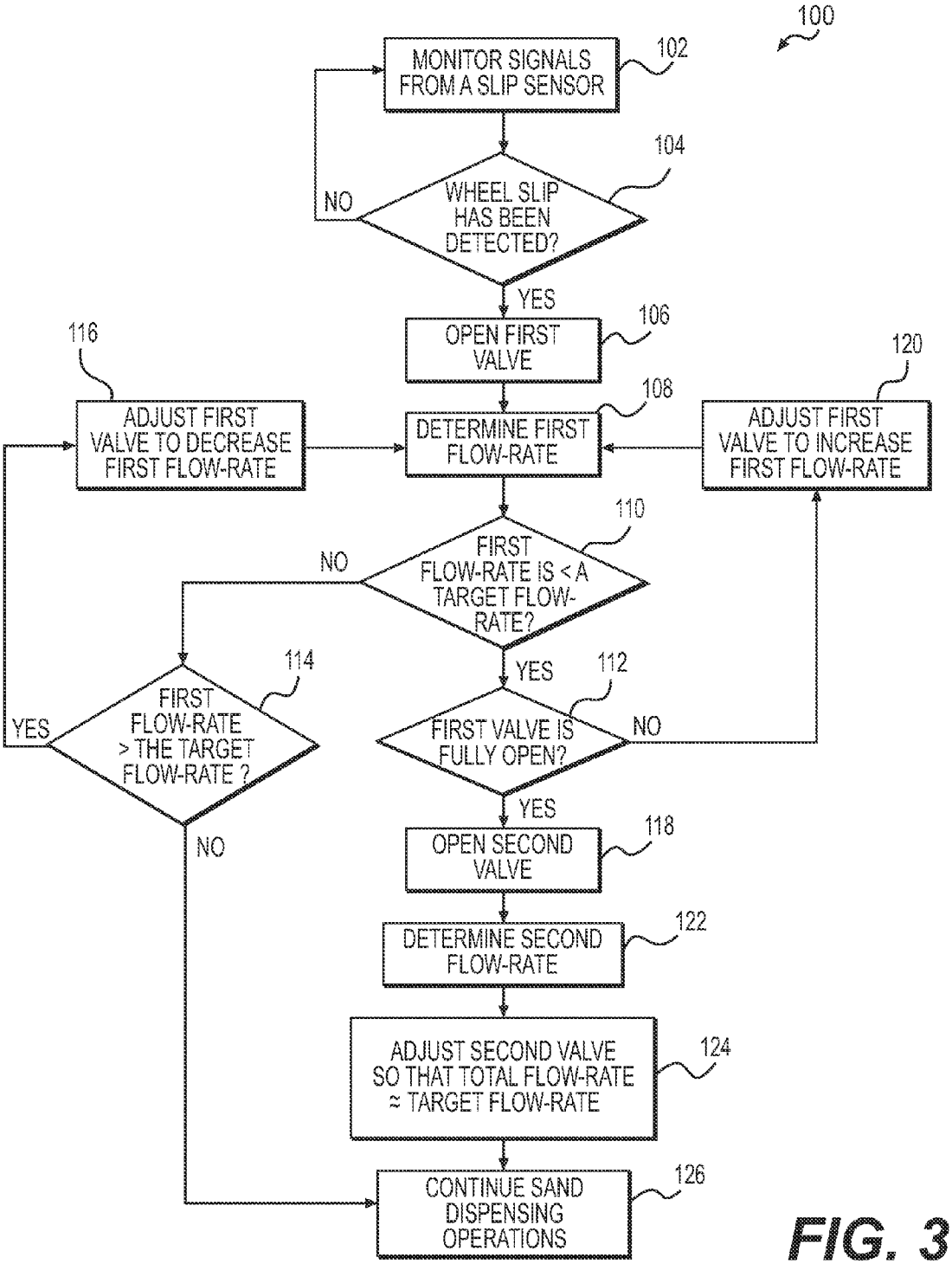
FIG. 3 is a flow chart illustrating an exemplary disclosed method of traction control performed by the sand monitoring and control system of FIG. 2.

FIG. 3 illustrates an exemplary method 100, which may be performed by sand monitoring and control system 40. Controller 64 may monitor signals from a slip sensor 62 (Step 102). Controller 64 may determine whether wheel slip has been detected (Step 104). Alternatively, controller 64 may determine whether the operator has activated button 72. When controller 64 determines that a wheel slip has been detected (Step 104, Yes) or when the operator has activated button 72, controller 64 may open first valve 54 (Step 106) to dispense sand from first sand box 24. When controller 64 determines, however, that no wheel slip has been detected (Step 104, No), controller 64 may return to step 102 and continue to monitor signals from slip sensor 62.

After opening first valve 54 in step 106, controller 64 may determine first flow-rate (Step 108) of sand flowing from first sand box 24. Controller 64 may determine the first flow-rate in many ways. For example, controller 64 may receive information from first sensor 58 about a level of sand in first sand box 24 at two different times. Controller may use information regarding the dimensions of first sand box 24 to determine an amount of sand in first sand box 24 based on the level at the two different times. Controller 64 may determine the first flow-rate based on the amounts of sand in first sand box 24 at the two different times and the elapsed time. In an exemplary embodiment, controller may receive information regarding the amounts of sand remaining in first sand box 24 at two different times directly from first sensor 56. Controller 64 may use this information to determine the first flow-rate of sand. For example, if the amounts of sand in first sand box 24 are determined to be Q1 and Q2 at times t1 and t2, respectively, controller 64 may determine the first flow-rate as a ratio of the amount of sand dispensed (Q1−Q2) and the time elapsed (t2−t1). It is contemplated that controller 64 may also determine the first flow-rate, for example, based on an amount by which first valve 54 may be open. For example, if first valve 54 is half-way open, controller 64 may determine the first flow-rate as half the maximum flow-rate allowed by first valve 54. It is further contemplated that controller 64 may determine the first flow-rate based on an amount or magnitude of wheel slip detected by slip sensor 62. For example, controller 64 may determine the first flow-rate of sand based on an amount of frictional force required to eliminate or reduce the detected amount of wheel slip. After determining the first flow-rate in step 108, controller 64 may proceed to step 110.

In step 110, controller 64 may determine whether the first-flow rate is <a target flow-rate. Controller 64 may receive information regarding the target flow-rate from server 92 via communications module 78. Server 92 may determine the target flow-rate based on historical data on sand usage from first and second sand boxes 24, 52 on one or more machines 10. Alternatively, server 92 may determine the target flow-rate based on a speed of machine 10. For example, server 92 may determine an amount of frictional force needed to reduce the speed of machine 10 from a current speed to a lower speed to prevent wheel slip. In an exemplary embodiment, server 92 may determine the target flow-rate based on characteristics of first valve 54. For example, server 92 may estimate a target flow-rate based on a maximum flow-rate of first valve 54. Server 92 may determine the maximum flow-rate based on the maximum amount of sand that may be dispensed from first sand box 24 through duct 26 in a given time period when first valve 54 is in a fully open position. Server 92 may communicate the target flow-rate to controller 64 directly or through communications module 78. Although in the above description, server 92 has been described as determining the target flow-rate, it is contemplated that controller 64 may determine the target-flow rate in a manner similar to that described for server 92.

When controller 64 determines that the first flow-rate is <a target flow-rate (Step 110, Yes), controller 64 may proceed to step 112. First flow-rate may be less than the target flow-rate for many reasons. For example, first flow-rate may be less than the target flow-rate because first sand box 24 may have run out of sand, because first valve 54 may be functioning improperly, or because of an undetected blockage in duct 26. As described below, method 100 may permit dispensing of sand from second sand box 52 in such cases to provide the operator of machine 10 an alternative option of performing traction control operations to reduce or eliminate a detected wheel slip condition.

When controller 64 determines, however, that the first flow-rate is not <the target flow-rate (Step 110, No), controller 64 may determine whether the first flow-rate>the target flow-rate (Step 114). When controller 64 determines that the first flow-rate is greater than the target flow-rate (Step 114, Yes), controller 64 may adjust first valve 54 to decrease the first flow-rate so that the first flow-rate is about equal to the target flow-rate (Step 116). When controller 64 determines, however, that the first flow-rate is not greater than the target flow-rate (Step 114, No), controller 64 may proceed to step 126. One of ordinary skill in the art would recognize that when the first flow-rate is neither less than the target flow-rate (Step 110, No) nor greater than the target flow-rate (Step 114, No), then first flow-rate would be equal to the target flow-rate.

Returning to step 112, controller 64 may determine whether first valve 54 is fully open (Step 112). When controller 64 determines that first valve 54 is fully open (Step 112, Yes), controller 64 may open second valve 56 (Step 118) to dispense sand from second sand box 52. When controller 64 determines, however, that first valve 54 is not fully open (Step 112, No), controller 64 may adjust first valve 54 to increase first flow-rate (Step 120). Thus when the first flow rate is less than the target flow-rate, controller 64 may adjust first valve 54 to increase the first flow-rate so that the first flow-rate is about equal to the target flow-rate. After adjusting first valve 54 in step 120, controller 64 may return to step 108 to determine first flow-rate again. Thus, by adjusting the first flow-rate to a target value, controller 64 may allow the operator of machine 10 to provide an adequate amount of sand to control a detected wheel slip condition on machine 10.

Continuing from step 118, controller 64 may determine second flow-rate (Step 122). Controller 64 may determine second flow-rate in a manner similar to that by which controller 64 determined first flow-rate in Step 108. Alternatively, server 92 may determine second flow-rate in a manner similar to its determination of first flow-rate described above and communicate the second flow-rate to controller 64 directly or via communications module 78. After determining second flow-rate, controller 64 may adjust second valve 56 so that total flow-rate≈(i.e. about equal to) target flow-rate (Step 124). Thus, by allowing sand from second sand box 52 to be dispensed when the first flow-rate of sand from first sand box 24 is below the target flow-rate, method 100 provides an improved way of performing traction control. Controller 64 may determine total flow-rate as a sum of the first and second flow-rates. Controller 64 may adjust second valve 56 by performing actions similar to those described above for first valve 54 in steps 114 and 116. After adjusting second valve 56, controller 64 may continue to step 126 to continue sand dispensing operations.

Controller 54 may end the sand dispensing operations by turning off first and/or second valves 54, 56 after a specified amount of time or when wheel slip has been eliminated or reduced to an acceptable amount. The specified amount of time may be determined by controller 64, server 92, or may be specified by an operator of machine 10. Controller 64 or server 92 may determine when wheel slip has been eliminated or reduced to an acceptable amount by monitoring signals from slip sensor 62.

Figure 4:
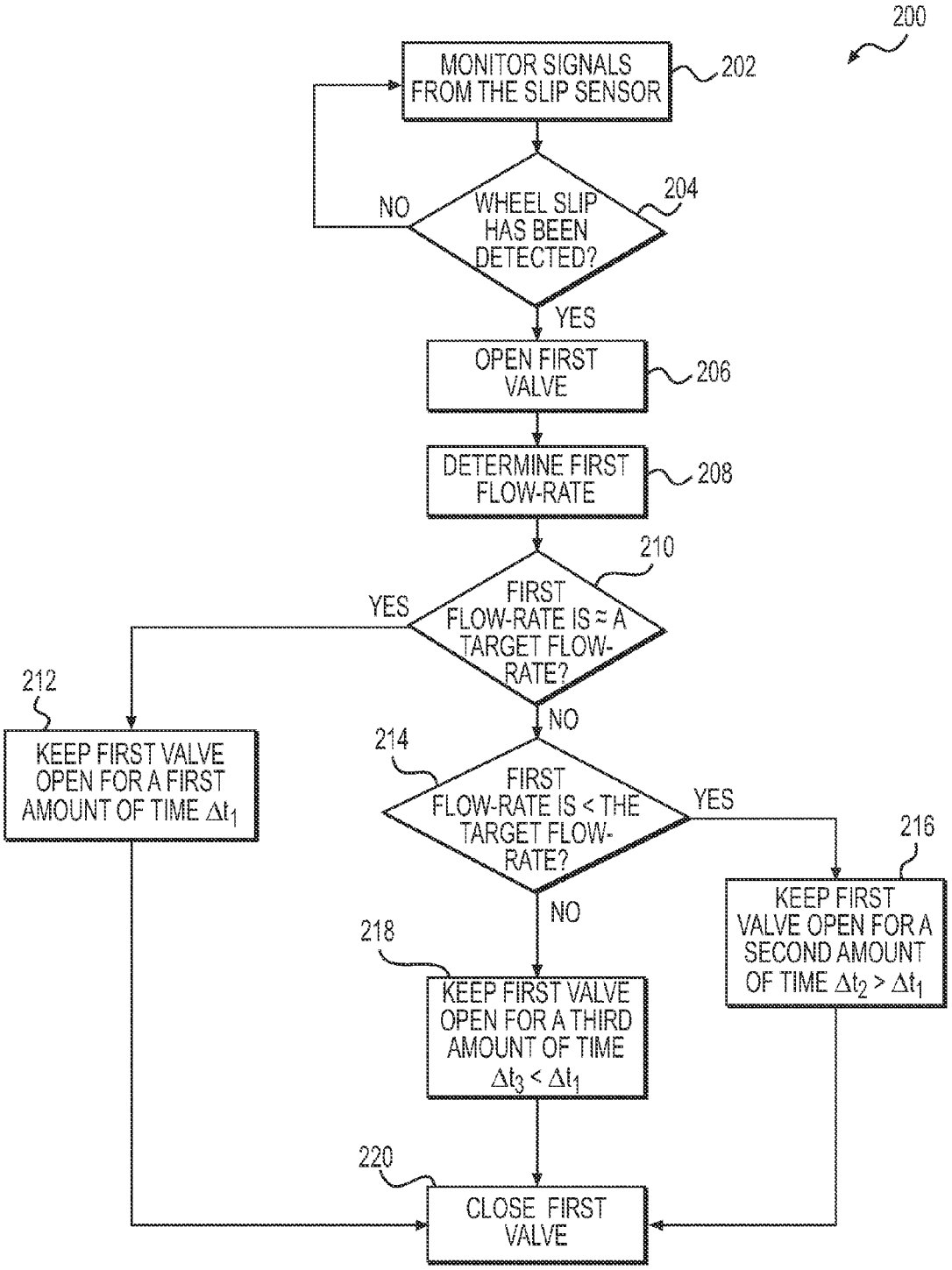
FIG. 4 is a flow chart illustrating another exemplary disclosed method of traction control performed by the sand monitoring and control system of FIG. 2.

FIG. 4 illustrates another exemplary method 200, which may be performed by sand monitoring and control system 40 when first and/or second valves 54, 56 are fixed-flow valves. Controller 64 may monitor signals from a slip sensor 62 (Step 202). Controller 64 may determine whether wheel slip has been detected (Step 204). Alternatively, controller 64 may determine whether the operator has activated button 72. When controller 64 determines that a wheel slip has been detected (Step 204, Yes) or when the operator has activated button 72, controller 64 may open first valve 54 (Step 206) to dispense sand from first sand box 24. When controller 64 determines, however, that no wheel slip has been detected (Step 204, No), controller 64 may return to step 202 and continue to monitor signals from slip sensor 62.

After opening first valve 54 in step 206, controller 64 may determine a first flow-rate (Step 208) of sand flowing from first sand box 24. Controller 64 may determine the first flow-rate using methods similar to those described above with regard to step 108 of method 100. After determining the first flow-rate in step 208, controller 64 may determine whether the first-flow rate is ≈(about equal to) a target flow-rate (Step 210). Controller 64 may determine or receive information regarding the target flow-rate in a manner similar to that described for method 100. When controller 64 determines that the first flow-rate is ≈a target flow-rate (Step 210, Yes), controller may keep first valve 54 open for a first amount of time Δt1 (Step 212). After the first amount of time Δt1 has elapsed, controller 64 may proceed to step 220. When controller 64 determines that the first flow-rate is not equal to the target flow-rate (Step 210, No), controller 64 may proceed to step 214.

Controller 64 may determine whether the first-flow rate is <the target flow-rate (Step 214). When controller 64 determines that the first flow-rate is <the target flow-rate (Step 214, Yes), controller 64 may keep first valve 54 open for a second amount of time Δt2>Δt1 (Step 216). By keeping first valve 54 open for a longer period of time compared to Δt1, controller 64 may ensure that sufficient sand may be dispensed to wheels 14, 16 to reduce or eliminate the detected wheel slip when first flow-rate is less than the target flow-rate. After time Δt2 has elapsed, controller 64 may proceed to step 220.

When controller 64 determines that the first flow-rate is not less than the target flow-rate (Step 214, No), controller 64 may keep first valve 54 open for a third amount of time Δt3<Δt1 (Step 218). By keeping first valve 54 open for a shorter period of time compared to Δt1, controller 64 may ensure that too much sand is not dispensed to wheels 14, 16 when the first flow-rate is greater than the target flow-rate. After time Δt3 has elapsed, controller 64 may proceed to step 220. Controller 64 may close first valve 54 (Step 220) to end sanding operations.

It will be apparent to those skilled in the art that various modifications and variations can be made to the disclosed sand monitoring and control system without departing from the scope of the disclosure. Other embodiments of the sand monitoring and control system will be apparent to those skilled in the art from consideration of the specification and practice of the sand monitoring and control system disclosed herein. It is intended that the specification and examples be considered as exemplary only, with a true scope of the disclosure being indicated by the following claims and their equivalents.

What is claimed is:

1. A sand monitoring and control system for a machine, comprising:
- a sand box configured to hold sand;
- a duct connected to the sand box and configured to dispense the sand from the sand box to a wheel of the machine;
- a valve connected to the duct;
- a controller in communication with the valve and configured to adjust the valve to control a flow rate of sand through the duct; and
- a sensor configured to determine amounts or levels of sand in the sand box at different times, wherein
- the controller is configured to determine the flow rate based on the determined amounts or levels.

2. The sand monitoring and control system of claim 1, wherein the controller is configured to trigger an alarm when the flow rate is less than a target flow rate.

3. The sand monitoring and control system of claim 2, wherein the controller is configured to determine the target flow rate based on a speed of the machine.

4. The sand monitoring and control system of claim 1, wherein the controller is configured to adjust the valve to:
- increase the flow-rate when the flow-rate is less than a target flow-rate; and decrease the flow-rate when the flow-rate exceeds the target flow-rate.

5. The sand monitoring and control system of claim 4, wherein the sand box is a first sand box, the duct is a first duct, the valve is a first valve, the wheel is a first wheel, the flow-rate is a first flow-rate, and the system includes:
- a second sand box;
- a second duct connected to the second sand box and configured to dispense sand from the second sand box to a second wheel of the machine;
- a second valve connected to the second duct, wherein the controller is:
  - in communication with the second valve, and
  - configured to adjust the second valve to control a second flow-rate of sand through the second duct.

6. The sand monitoring and control system of claim 5, wherein the controller is configured to open the second valve when the first valve is fully open and the first flow-rate is below the target flow-rate.

7. The sand monitoring and control system of claim 1, wherein the controller is configured to determine the flow-rate based on a detected amount of wheel slip.

8. A method of traction control for a machine, comprising:
- detecting wheel slip using a slip sensor;
- opening a valve to allow sand to flow from a sand box through a duct when wheel slip has been detected;
- dispensing the sand to a wheel of the machine;
- determining a first amount or level of sand in the sand box at a first time;
- determining a second amount or level of sand in the sand box at a second time;
- determining a flow-rate of the sand flowing through the duct, using a controller, based on the first amount or level, the second amount or level, the first time, and the second time; and
- adjusting the valve to control the flow-rate.

9. The method of claim 8, wherein adjusting the valve includes:
- selectively closing the valve to decrease the flow-rate, when the flow-rate is greater than a target flow-rate; and
- selectively opening the valve to increase the flow-rate, when the flow-rate is less than the target flow-rate.

10. The method of claim 9, further including:
- determining the target flow-rate; and
- triggering an alarm when the flow-rate is less than the target flow-rate.

11. The method of claim 10, wherein determining the target flow-rate includes:
- determining a speed of the machine; and
- determining the target flow-rate based on the speed.

12. The method of claim 8, wherein the sand box is a first sand box, the valve is a first valve, the flow-rate is a first flow-rate, and adjusting the valve further includes:
- determining whether the first flow-rate is less than a target flow-rate;
- determining whether the first valve is fully open;
- opening a second valve associated with a second sand box, when the first valve is fully open and the first flow-rate is less than the target flow-rate; and adjusting a second flow-rate of sand from the second sand box, such that a total flow-rate of sand is about equal to the target flow-rate.

13. The method of claim 8, wherein adjusting includes keeping the valve open for a first amount of time, the method further including:

closing the valve after the first amount of time has elapsed.

14. The method of claim 13, further including determining a target flow-rate, wherein adjusting further includes:

keeping the valve open for a second amount of time greater than the first amount of time when the flow-rate is less than the target flow-rate; and keeping the valve open for a third amount of time smaller than the first amount of time when the flow-rate is greater than the target flow-rate.

15. A mobile machine comprising:

a platform;

a plurality of wheels configured to support the platform;

a first sand box disposed on the platform;

a second sand box disposed on the platform;

a first sensor configured to determine a first level of sand in the first sand box;

a second sensor configured to determine a second level of sand in the second sand box;

a first duct connected to the first sand box and configured to dispense sand from the first sand box to a first wheel;

a second duct connected to the second sand box and configured to dispense sand from the second sand box to a second wheel;

a first valve connected to the first duct;

a second valve connected to the second duct; and a controller configured to determine the flow rate based on the determined level of sand; and to adjust the first valve and the second valve to control a first flow-rate of sand from the first sand box and a second flow-rate of sand from the second sand box.

16. The mobile machine of claim 15, wherein the controller is configured to:

selectively open the first valve to increase the first flow-rate, when the first flow-rate is below a target flow-rate; and selectively close the first valve to decrease the first flow-rate, when the first flow-rate is above the target flow-rate.

* * * * *